United States Patent [19]

Jones et al.

[11] Patent Number: 4,467,153

[45] Date of Patent: Aug. 21, 1984

[54] SHOCK AND VIBRATION SENSITIVE SWITCH

[75] Inventors: Arnold H. Jones; Donald L. Grissom, both of Blacksburg, Va.

[73] Assignee: Litton Systems, Inc., Blacksburg, Va.

[21] Appl. No.: 464,344

[22] Filed: Feb. 7, 1983

[51] Int. Cl.[3] ..... H01H 35/02

[52] U.S. Cl. ..... 200/61.45 R; 200/61.52; 200/DIG. 29; 200/5 EA

[58] Field of Search ..... 200/61.45 R, 61.45 M, 200/61.52, 61.53, 61.83, DIG. 29, 153 A, 277, 5 EA; 340/665, 669

[56] References Cited

U.S. PATENT DOCUMENTS

| | | | |
|---|---|---|---|
| 2,799,741 | 7/1957 | Ullman | 200/61.52 |
| 2,892,049 | 6/1959 | Rubenstein | 200/61.52 |
| 3,281,544 | 11/1964 | Bailey | 200/5 EA |
| 4,001,185 | 1/1977 | Mitsui | 200/61.45 |

FOREIGN PATENT DOCUMENTS

| | | | |
|---|---|---|---|
| 91163 | 11/1922 | Austria | 200/61.52 |
| 3022878 | 1/1982 | Fed. Rep. of Germany R | 200/61.45 |
| 854131 | 1/1940 | France | 200/81.9 R |

*Primary Examiner*—Joseph W. Hartary
*Assistant Examiner*—M. Reinhart
*Attorney, Agent, or Firm*—Brian L. Ribando

[57] ABSTRACT

A shock and vibration sensitive switch includes two E-shaped electrodes mounted on opposite sides of a cavity. Two inertia weights are supported by the electrodes in an electrical parallel arrangement to provide redundant current paths. The redundant current paths allow proper switch operation in the event of failure of one of the current paths. The switch is hermetically sealed to prevent moisture and the contaminants outgassed by the switch lead wires from entering the interior of the switch.

3 Claims, 2 Drawing Figures

SHOCK AND VIBRATION SENSITIVE SWITCH

BACKGROUND OF THE INVENTION

This invention relates to a shock and vibration sensitive switch used to detect the presence of unwanted intruders.

Shock and vibration sensitive switches are well known in the art. Such switches are used in burglar alarm type systems and are mounted on a wall or a fence in order to detect the shock and vibrational waves which accompany the approach of an intruder. Such devices normally comprise an inertia weight which is supported by two or more electrical contacts. The weight completes an electrical circuit between the contacts when the switch is in an quiescent state, but the presence of shock or vibrational waves causes the weight to bounce off of the contacts, thus, interrupting the circuit. This interruption is detected by suitable electronic means and an alarm is sounded.

Inertia switches are prone to malfunction because of non-conducting films which form on the surface of the contacts and the inertia weight, thus preventing the weight from establishing the desired closed circuit condition. Additionally, minute particules of plastic or other foreign material which are present in the switch case may accumulate on the conductive surfaces and interfere with the normal operation thereof. Moisture and air-borne contaminants may enter the switch case and initiate corrosion of the metallic elements. It would be desirable, therefore, to provide a shock and vibration sensitive switch which would be resistant to such failure.

SUMMARY AND OBJECTS OF THE INVENTION

According to the invention a shock and vibration sensitive switch comprises a plurality of inertia weights each of which complete a circuit across a pair of conductive contacts. The inertia elements and contacts are arranged in electrical parallel and provide redundant electrical circuit paths for the switch. The switch housing is hermetically sealed to prevent the ingress of moisture or air-borne contaminants which would interfere with the normal operation of the switch.

It is therefore an object of the invention to provide an improved shock and vibration sensitive switch.

It is another object of the invention to provide a shock and vibration sensitive switch which utilizes two inertia elements arranged in electrical parallel to provide redundant operation for the switch.

It is yet another object of the invention to provide a shock and vibration sensitive switch which is hermetically sealed.

These and other objects of the invention will become apparent from the following description of the invention taken in conjunction with the accompanying drawing figures.

DESCRIPTION OF THE PREFERRED EMBODIMENT

Figure 1:
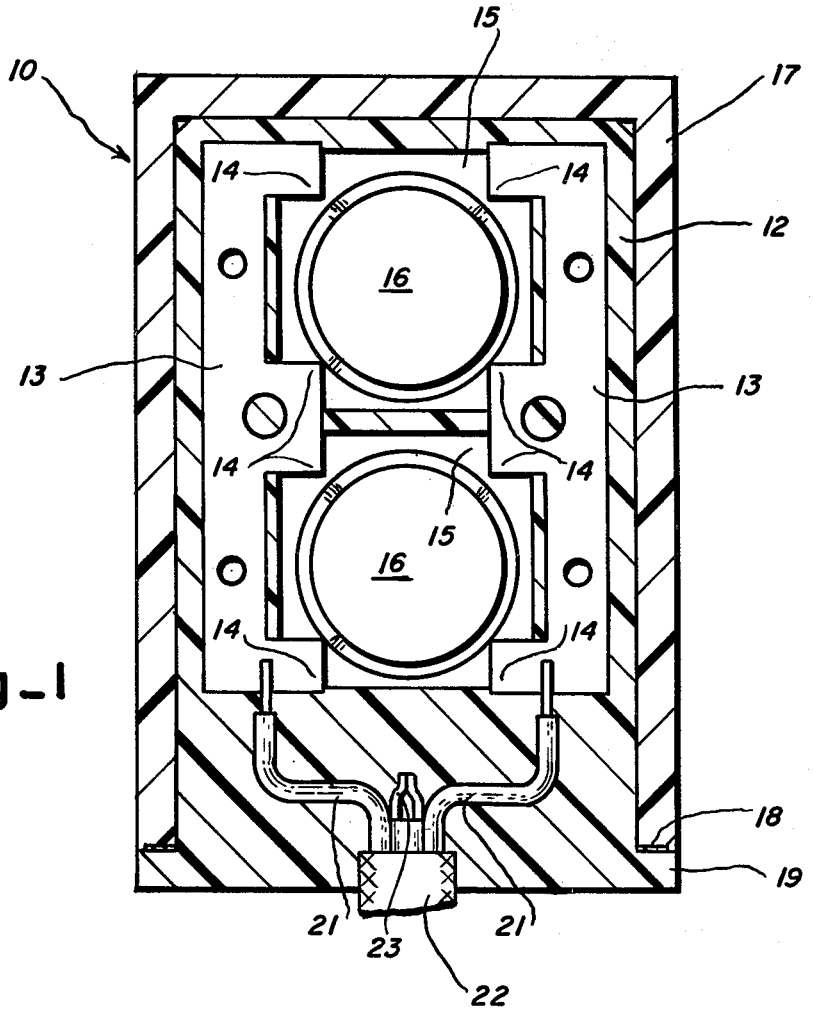
FIG. 1 shows a sectional view of a shock and vibration sensitive switch.
Figure 2:
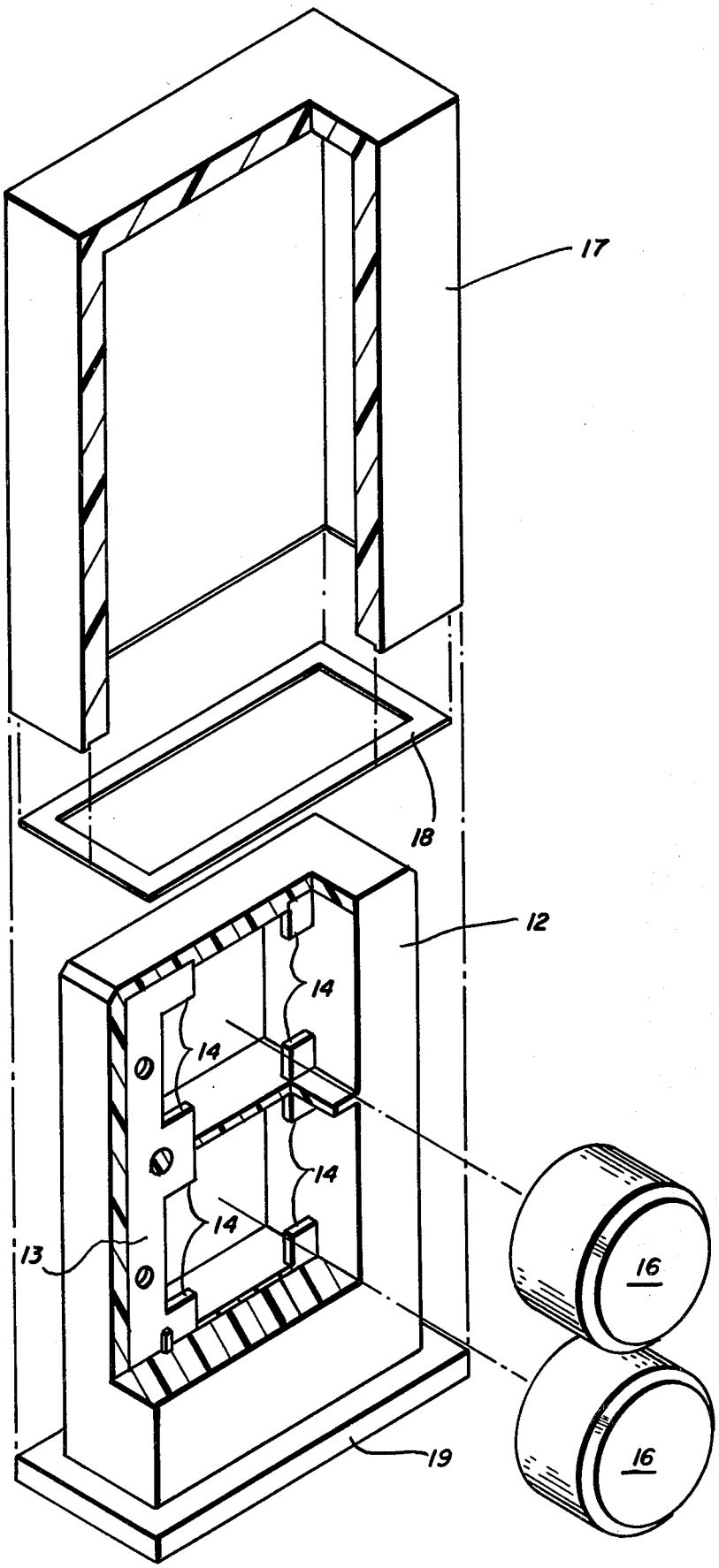
FIG. 2 shows an exploded view of a shock and vibration sensitive switch according to the invention.

Turning now to the drawing figures there is shown in FIGS. 1 and 2 a shock and vibration sensitive switch generally indicated by the reference numeral 10. The switch comprises an insulating frame member 12 in which are mounted a plurality of E-shaped contacts 13 on either side of a central cavity 15. Each E-shaped contact 13 includes a plurality of contact points 14 which are used to support inertia weights 16. The sharp corners of the contact points 14 will pierce through any non-conducting film which may form on the inertia weight 16 and the location of the contact points 14 prevent the inertia weight 16 from touching the switch frame 12.

A five-sided cover member 17 is dimensioned to provide an interference fit over the outer surface of the frame 12 to seal the central cavity 15 from the environment. Additional sealing is provided by a heat actuated epoxy gasket 18 which is fitted between the open side of the cover member 17 and a flange 19 which is formed on the base of the frame 12.

Contact leads 21 are fixed to each of the contacts 13 by suitable means such as soldering or resistance welding. The contact leads together with twisted pari 23 comprise the end portions of hook-up wire 22 which is used to couple the shock and vibration sensitive switch into an alarm system. The end of the hook-up wire 22 and the contact leads 21, including the portions of the contact leads which are welded to the contact members 13 are encapsulated within the base portion of the frame 12. The encapsulation of the hook-up wire and the contact leads prevents contaminants which outgas from the hook-up wire insulation or solder flux from entering the cavity 15 which contains the inertia weights 16. Thus, such outgas contaminants are unable to affect the conductive surfaces of the contact points 14 and the weights 16 upon which the desired operation of the switch relies. Additionally, the epoxy gasket 18 provides a hermetic seal between the frame flange 19 and the cover member 17 preventing the passage of any moisture therepast.

In operation the four contact points 14 which surround each of the inertia weights 16 allow the switch 10 to be mounted in the position shown in FIG. 1, with the flange 19 at the bottom of the unit, or reversed, with the flange at the top. In either position, each of the inertia weights will be supported by two of the contact points 14, thus completing two parallel electric circuit paths between the E shaped contacts 13. Shock or vibrational forces applied to the switch 10 will cause the inertia weights 16 to bounce on the contact points 14 to interrupt the electrical circuit. After the disturbance has occurred, the inertia weights will reseat on the contact points 14. If for some reason one of the inertia weights fails to reseat, however, the electrical circuit between the two contacts 13 will be completed by the other inertia weight, since the two are in electrical parallel. This ararangement reduces significantly the occurrance of switch failure.

Having thus described the invention, various modifications and alterations will occur to those skilled in the art, which modifications and alterations are intended to be within the scope of the appended claims.

What is claimed is:

1. A shock and vibration sensitive switch for detecting the presence of a intruder comprising:

a frame member surrounding an open cavity, two E shaped electrodes mounted in said frame member on opposite sides of said cavity and a plurality of contact points presented by said electrodes and protruding into said cavity, two inertia weights each supported by two contact points such that each of said inertia weights completes an electrical circuit from one of said E shaped contacts to the other, whereby said inertia weights are in an electrical parallel arrangement, and whereby said inertia weights provide redundant current paths allowing proper switch operation in the event of failure of one of said current paths.

2. The shock and vibration sensitive switch of claim 1 further comprising a cover friction fitted to said frame, a flange formed on the base of said frame a gasket mounted on said flange and adapted to seal against said cover, whereby moisture and foreign contaminants are prevented from entering said cavity.

3. The shock and vibration sensitive switch further comprising:

lead wires coupled to said E shaped electrodes, and base material of said frame encapsulating said lead wires, whereby contaminants outgassed by said lead wires are trapped by said base material and unable to enter said cavity.

* * * * *